US011136786B2

(12) United States Patent
Colligan et al.

(10) Patent No.: US 11,136,786 B2
(45) Date of Patent: Oct. 5, 2021

(54) CONFINEMENT ROOM LOCK

(71) Applicant: Accurate Lock & Hardware Co. LLC, Stamford, CT (US)

(72) Inventors: Francis Colligan, New Haven, CT (US); Jeffrey J. Graveline, Litchfield, CT (US)

(73) Assignee: Accurate Lock & Hardware Co. LLC, Stamford, CT (US)

( * ) Notice: Subject to any disclaimer, the term of this patent is extended or adjusted under 35 U.S.C. 154(b) by 228 days.

(21) Appl. No.: 16/437,644

(22) Filed: Jun. 11, 2019

(65) Prior Publication Data

US 2019/0390481 A1 Dec. 26, 2019

Related U.S. Application Data

(60) Provisional application No. 62/690,152, filed on Jun. 26, 2018.

(51) Int. Cl.

| | |
|---|---|
| ***E05B 35/08*** | (2006.01) |
| ***E05B 17/14*** | (2006.01) |
| ***E05B 63/00*** | (2006.01) |
| ***E05B 1/00*** | (2006.01) |
| ***E05B 13/00*** | (2006.01) |

(Continued)

(52) U.S. Cl.

CPC ..... *E05B 35/08* (2013.01); *E05B 1/0015* (2013.01); *E05B 13/001* (2013.01); *E05B 17/14* (2013.01); *E05B 17/142* (2013.01); *E05B 17/185* (2013.01); *E05B 63/0069* (2013.01); *E05B 63/08* (2013.01)

(58) Field of Classification Search

CPC ..... E05B 1/00; E05B 1/0007; E05B 13/001; E05B 17/04; E05B 17/14; E05B 17/142; E05B 17/18; E05B 17/185; E05B 63/0065; E05B 63/0069; E05B 63/0078; E05B 63/08; E05B 35/08; E05B 35/10; E05B 35/105

See application file for complete search history.

(56) References Cited

U.S. PATENT DOCUMENTS

| | | | |
|---|---|---|---|
| 1,434,370 | A | 11/1922 | Crompton et al. |
| D114,315 | S | 4/1939 | Brodbeck |
| 3,038,757 | A | 6/1962 | Schulze |

(Continued)

FOREIGN PATENT DOCUMENTS

| | | | |
|---|---|---|---|
| JP | 2004162401 | A | 6/2004 |

*Primary Examiner* — Christopher J Boswell
(74) *Attorney, Agent, or Firm* — Forge IP, PLLC

(57) ABSTRACT

A lock assembly for a door includes a lock mechanism moveable between an extended position wherein the door is locked and a retracted position wherein the door is unlocked such that the door may be opened and closed. The lock assembly also includes first and second lock cylinders operably connected to the lock mechanism such that actuation thereof causes the lock mechanism to move to the retracted position, the lock cylinders each including a first keyhole. A tamper resistant member is moveable between a protected position in which the keyhole of the second cylinder is inaccessible and an unprotected position in which the keyhole of the second cylinder is accessible, such that a tool is required in order to move the tamper resistant member from the protected position to the unprotected position, the tool adapted to be stored separately from the door.

24 Claims, 5 Drawing Sheets

(51) Int. Cl.
*E05B 17/18* (2006.01)
*E05B 63/08* (2006.01)

(56) References Cited

U.S. PATENT DOCUMENTS

| | | | | | |
|---|---|---|---|---|---|
| 3,203,210 | A * | 8/1965 | Check | E05B 35/08 | 70/340 |
| 3,713,683 | A | 1/1973 | Neary | | |
| 3,813,905 | A * | 6/1974 | Sauder | E05B 35/08 | 70/339 |
| 4,064,721 | A | 12/1977 | Morgan | | |
| 4,073,165 | A * | 2/1978 | Grundstrom | E05B 17/185 | 70/37 |
| 4,492,394 | A | 1/1985 | Dignan | | |
| 4,575,141 | A | 3/1986 | Burns | | |
| 5,195,342 | A * | 3/1993 | Werner | E05B 17/14 | 411/910 |
| 5,249,444 | A * | 10/1993 | Danes | E05B 17/04 | 70/380 |
| 5,303,965 | A | 4/1994 | Meehan | | |
| 5,737,948 | A * | 4/1998 | Lefkovits | E05B 17/142 | 70/164 |
| 5,797,286 | A | 8/1998 | Armstrong | | |
| 6,460,906 | B2 | 10/2002 | Bingle et al. | | |
| 7,373,694 | B1 | 5/2008 | Kopp | | |
| 7,617,707 | B2 | 11/2009 | Chiang | | |
| 7,802,828 | B2 | 9/2010 | Hopkins et al. | | |
| 8,430,436 | B2 * | 4/2013 | Shilts | E05B 1/0007 | 292/347 |
| 8,459,072 | B2 * | 6/2013 | Bisson | E05B 15/06 | 70/455 |
| 9,631,398 | B1 * | 4/2017 | Liu | E05B 17/185 | |
| 9,694,505 | B2 * | 7/2017 | Clifford | B26D 1/025 | |
| 9,714,525 | B2 * | 7/2017 | Eller | E05B 65/0032 | |
| 10,253,526 | B2 * | 4/2019 | Trent | E05B 35/10 | |
| 10,415,267 | B1 * | 9/2019 | Schmutz | E05B 9/002 | |
| 2003/0150247 | A1 | 8/2003 | Talpe | | |
| 2010/0013248 | A1 | 1/2010 | Keller | | |
| 2010/0072762 | A1 | 3/2010 | Marks | | |
| 2010/0126239 | A1 | 5/2010 | Berger | | |
| 2010/0327611 | A1 | 12/2010 | Rees | | |
| 2011/0174026 | A1 * | 7/2011 | Salvatore | E05B 15/10 | 70/91 |

* cited by examiner

CONFINEMENT ROOM LOCK

FIELD OF THE INVENTION

The present invention relates to door hardware, and more specifically, to door lock assemblies particularly adapted for use in connection with confinement rooms.

BACKGROUND OF THE INVENTION

Door lock assemblies are often used in institutional environments, such as hospitals, prisons, mental institutions or the like where persons are confined within a room (hereinafter "confinement rooms"). Typically, in such situations, there is no means on the inside of the room for the confined person to lock/unlock the door. Instead, in a confinement room situation, there is often a lock cylinder on the outside of the room allowing an authorized person (i.e., a person with a key) to lock/unlock the door so that it can be opened and closed. In many cases, there is also no knob or the like on the inside of the door, particularly in situations where anti-ligature concerns exist.

What is meant by "anti-ligature concerns" is that in many environments such as, for example, although not limited thereto, medical facilities, schools, offices, government buildings, residences, and other institutions, there exists a population of people at risk of committing suicide. In many psychiatric hospitals, for example, patients have been known to attempt suicide, specifically hanging, while in the care of the institution.

These suicide attempts are known to have involved the use of doorknobs, hinges and other door hardware, particularly since an effort is often made to remove other ligature anchor points from the facilities. Institutions have many private rooms where such a suicide attempt may take place, such as rooms where individuals are confined (so-called "confinement rooms"). Every private room cannot be watched at the same time without enormous staff resources. Therefore, private rooms, and specifically door hardware in these rooms, provide an area of opportunity for a suicide attempt.

The problem of suicide attempts has been addressed in some institutions by simply removing all door hardware, and even the doors themselves. While this may reduce the opportunity for suicide attempts, it likewise eliminates all privacy and security. In particular, it is not possible to remove all door hardware in connection with confinement rooms, or else they will no longer function as such.

Many current designs for anti-suicide door hardware have focused thus far on the designs of the door knobs, latches, thumb turns, hinges, etc. In the confinement room situation, as described above, there is often a lock cylinder on the outside of the room allowing an authorized person (i.e., a person with a key) to lock/unlock the door so that it can be opened and closed. Such a lock cylinder generally does not present any issued from an anti-ligature perspective.

A problem exists, however, in that other persons in the hospital, prison, mental institution or the like may tamper with the lock cylinder, rendering it inoperable, possibly resulting in the confined person being locked in the room. For example, a person outside the locked room may press chewing gum into the lock cylinder, or may insert an object, such as a toothpick, into the lock cylinder and break off the end. When this occurs, the key may be rendered useless, such that the confined person may be trapped in the room until a locksmith can be called. Obviously, this can cause serious problems in the event of a fire, medical emergency or the like.

While it is known to provide door hardware having two separate lock cylinders, either of which can be used to open the door, such does not remedy the problem discussed above. Known dual cylinder door hardware is merely intended to allow for two different keys to open the same door. However, if both cylinders are tampered with (which would be very simple to accomplish with prior art dual cylinder designs) the confined person may again be trapped in the room until a locksmith can be called, which may take many hours.

It is therefore desired to provide a door lock assembly with safety features making it less likely that a confined person will be trapped in a room for extended periods of time as a result of simple tampering with the lock assembly from outside the room. It is further desirable for such a door lock assembly to be configured such that it is appropriate for use in an anti-ligature environment.

SUMMARY OF THE INVENTION

To this end, a lock assembly for a door is provided, the lock assembly including a lock mechanism moveable between an extended position wherein the door is locked and a retracted position wherein the door is unlocked such that the door may be opened and closed. The lock assembly also includes a first lock cylinder operably connected to the lock mechanism such that actuation of the first lock cylinder causes the lock mechanism to move to the retracted position, the first lock cylinder comprising a first keyhole, and a second lock cylinder operably connected to the lock mechanism such that actuation of the second lock cylinder causes the lock mechanism to move to the retracted position, the second lock cylinder comprising a second keyhole. A tamper resistant member is moveable between a protected position in which the second keyhole of the second cylinder is inaccessible and an unprotected position in which the second keyhole of the second cylinder is accessible, such that a tool is required in order to move the tamper resistant member from the protected position to the unprotected position, the tool adapted to be stored separately from the door.

In some embodiments, the first lock cylinder and the second lock cylinder are identically keyed, such that one and the same key actuates both the first lock cylinder and the second lock cylinder.

In some embodiments, the tamper-resistant member comprises a plate moveable between the protected position, in which the plate covers the second keyhole of the second cylinder, and the unprotected position wherein the plate no longer covers the second keyhole of the second cylinder. In certain of these embodiments, the plate is pivotably connected to the door on one side, and has an opening on another side adapted to receive a tamper resistant fastener such that plate is fastenable in the protected position using the tamper resistant fastener, but is pivotable to the unprotected position when the tamper resistant fastener is removed. In certain embodiments, the tamper resistant fastener comprises a security torx screw and the tool comprises a security torx screwdriver.

In some embodiments, the lock mechanism is biased toward an extended position such that actuation of one of the first lock cylinder and the second lock cylinder causes a temporary retraction of the lock mechanism, with the lock mechanism automatically returning to the extended position when the actuation of one of the first lock cylinder and the second lock cylinder is ceased. In other embodiments, the lock mechanism is unbiased such that one of the first lock cylinder and the second lock cylinder must be actuated both to retract and extend the lock mechanism.

In some embodiments, the lock assembly further includes a door pull to facilitate opening and closing of the door. In certain of these embodiments, the door pull is rounded such that the door pull is free of ligature points.

In some embodiments, a first escutcheon plate is disposed on a same side of the door as the first lock cylinder, the second lock cylinder and the tamper resistant member. In certain of these embodiments, a second escutcheon plate is disposed on an opposite side of the door as the first lock cylinder, the second lock cylinder, the tamper resistant member and the first escutcheon plate. In certain embodiments, the door is particularly adapted as a door for a confinement room, and the side of the door with the second escutcheon plate faces into the confinement room.

In some embodiments, the lock assembly is configured as a mortise lock.

In accordance with another aspect of the present invention, a lock assembly for a door includes a lock mechanism moveable between an extended position wherein the door is locked and a retracted position wherein the door is unlocked such that the door may be opened and closed. A first lock cylinder is operably connected to the lock mechanism such that actuation of the first lock cylinder causes the lock mechanism to move to the retracted position, the first lock cylinder comprising a first keyhole, and a second lock cylinder is operably connected to the lock mechanism such that actuation of the second lock cylinder causes the lock mechanism to move to the retracted position, the second lock cylinder comprising a second keyhole. The first lock cylinder and the second lock cylinder are identically keyed, such that one and the same key actuates both the first lock cylinder and the second lock cylinder. A plate is moveable between a protected position in which the plate covers the second keyhole of the second cylinder such that the second keyhole of the second cylinder is inaccessible and an unprotected position in which the plate no longer covers the second keyhole of the second cylinder such that the second keyhole of the second cylinder is accessible, the plate being pivotably connected to the door on one side, and having an opening on another side adapted to receive a tamper resistant fastener such that plate is fastenable in the protected position using the tamper resistant fastener, but is pivotable to the unprotected position when the tamper resistant fastener is removed.

In some embodiments, a tool is required in order to remove the tamper resistant fastener such that the plate is moveable from the protected position to the unprotected position, the tool adapted to be stored separately from the door. In certain of these embodiments, the tamper resistant fastener comprises a security torx screw and the tool comprises a security torx screwdriver.

In some embodiments, the lock mechanism is biased toward an extended position such that actuation of one of the first lock cylinder and the second lock cylinder causes a temporary retraction of the lock mechanism, with the lock mechanism automatically returning to the extended position when the actuation of one of the first lock cylinder and the second lock cylinder is ceased. In other embodiments, the lock mechanism is unbiased such that one of the first lock cylinder and the second lock cylinder must be actuated both to retract and extend the lock mechanism.

In some embodiments, the lock assembly further includes a door pull to facilitate opening and closing of the door. In certain of these embodiments, the door pull is rounded such that the door pull is free of ligature points.

In some embodiments, a first escutcheon plate is disposed on a same side of the door as the first lock cylinder, the second lock cylinder and the plate. In certain of these embodiments, a second escutcheon plate is disposed on an opposite side of the door as the first lock cylinder, the second lock cylinder, the plate and the first escutcheon plate. In certain embodiments, the door is particularly adapted as a door for a confinement room, and the side of the door with the second escutcheon plate faces into the confinement room.

In some embodiments, the lock assembly is configured as a mortise lock.

The present invention thus provides a door lock assembly with safety features making it less likely that a confined person will be trapped in a room for extended periods of time as a result of simple tampering with the lock assembly from outside the room. The present invention further provides such a door lock assembly configured such that it is appropriate for use in an anti-ligature environment.

Other objects of the invention and its particular features and advantages will become more apparent from consideration of the following drawings and accompanying detailed description.

DETAILED DESCRIPTION OF THE INVENTION

Figure 1:
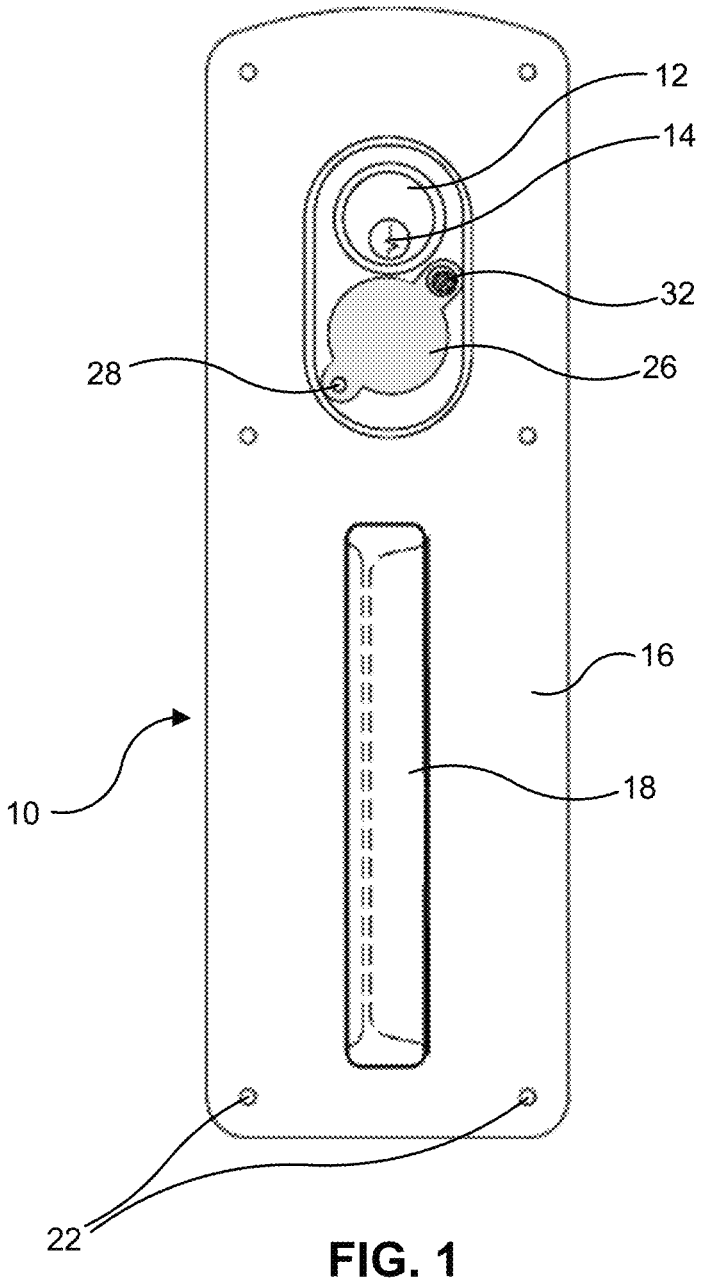
FIG. 1 illustrates the outer side (i.e., the side facing away from a confinement room) of a door lock assembly according to an exemplary embodiment of the present invention in a state of regular use.

Referring now to the drawings, wherein like reference numerals designate corresponding structure throughout the views, FIG. 1 illustrates the outer side of a door lock assembly (10) according to an exemplary embodiment of the present invention in a state of regular use. As can be seen, the lock assembly (10) includes an exposed lock cylinder (12), with a keyhole (14) as is known in the prior art. The lock cylinder (12) can be of any known or later developed type, and employ any of numerous types of keys.

In the shown embodiment, the door lock assembly (10) also includes an escutcheon plate (16), and an anti-ligature door pull (18) (better seen in FIG. 4), although both of these features are optional. The escutcheon plate (16) may be affixed to the door (20) (shown in FIG. 4) by way of a plurality (six are shown in FIG. 1) of fasteners (22). Fasteners (22) may be of a conventional type (e.g., a Philips head screw), although preferably the fasteners (22) are of a tamper resistant variety, such as security torx screws or the like.

The door lock assembly (10) according to the present invention also includes a secondary lock cylinder (24), which is shown as being positioned just below the exposed lock cylinder (12) in FIGS. 1 and 2, although such placement is not required. This secondary lock cylinder (24), in regular use (as shown in FIG. 1), is concealed by a tamper resistant cover (26), which is not readily accessible by an ordinary person (i.e., a person without specialized tools).

Figure 2:
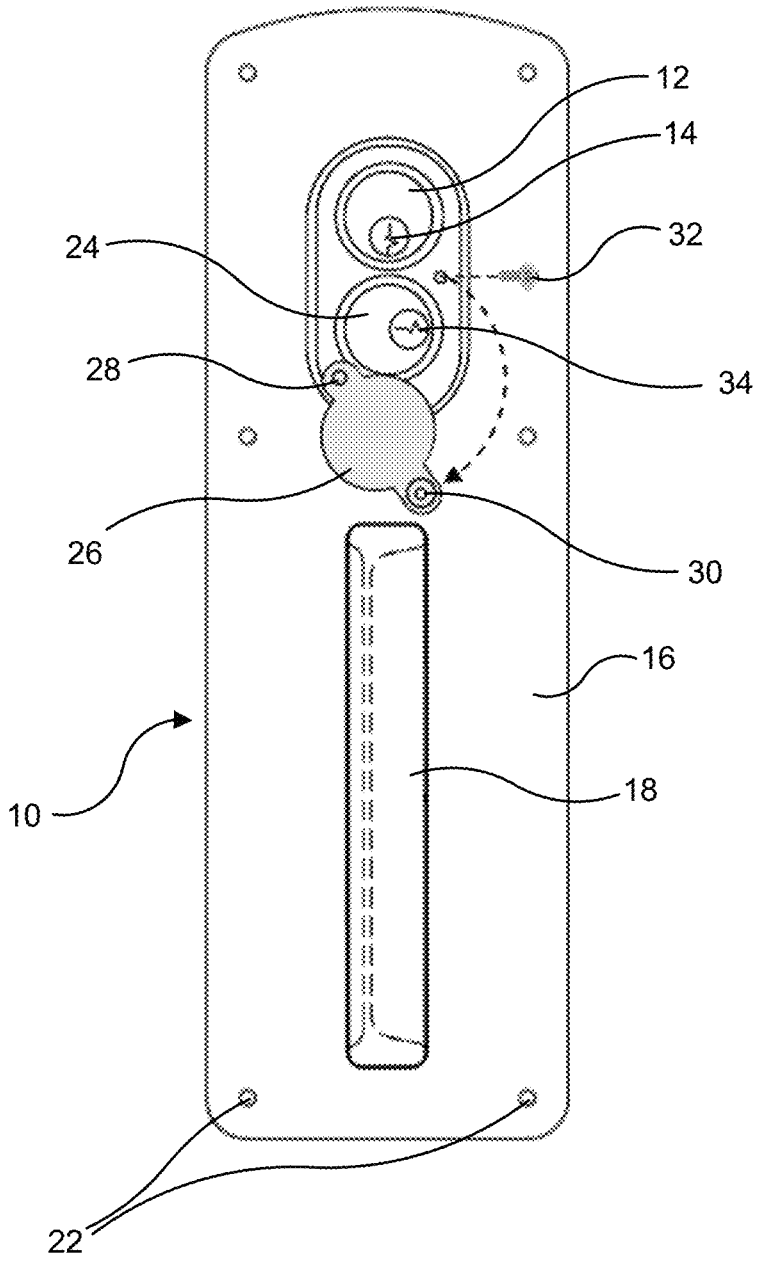
FIG. 2 illustrates the outer side of the door lock assembly of FIG. 1 showing a state of emergency use.

In the exemplary embodiment shown in FIGS. 1 and 2, the tamper resistant cover (26) is provided with a pivotable connection (28) connecting it to the door hardware on one side, and the other side of the cover is provided with an opening (30) so that it can be affixed to the door hardware using a tamper resistant fastener (32), such as security torx screw or the like, which requires a specialized tool not likely to be in the possession of typical persons in the hospital, prison, mental institution or the like. As shown in FIG. 2, if the primary lock cylinder (12) is rendered inoperable, the tamper resistant fastener (32) can be removed using the afore-mentioned specialized tool (which may, for example, be kept in an administrative office, a security office, a maintenance office or the like), and the cover (26) can be swung out of the way (illustrated by dashed lines in FIG. 2) in order to expose the secondary lock cylinder (24).

Of course, other tamper resistant configurations are possible. For example, instead of a pivoting connection on one end, two, three or more tamper resistant fasteners (such as security torx screws or the like) may be employed. Or, instead of security torx screws, one or more other types of tamper resistant fasteners may be employed.

The exact type of tamper resistant fastener used is unimportant. What is important, however, is that the tool required to remove the fastener is not readily available to persons in the hospital, prison, mental institution or the like, but is fairly readily available to authorized personnel (i.e., more quickly than calling in a locksmith). It is also important that the fastener itself not be easily disabled (e.g., by chewing gum or the like), such that the secondary lock cylinder can be readily accessed by authorized personnel when desired. Given all of these considerations, it has been found that security torx screws are indeed suitable options.

The secondary lock cylinder (24) has a keyhole (34) that is preferably keyed the same as the keyhole (14) of the primary lock cylinder (12). While such is not strictly necessary, this is advantageous so that maintaining a second key is not required, since a second key, if different than the primary key, may be subject to being lost, particularly if it is not used very often (i.e., when it is used only in cases where a primary lock cylinder has been tampered with).

Figure 3:
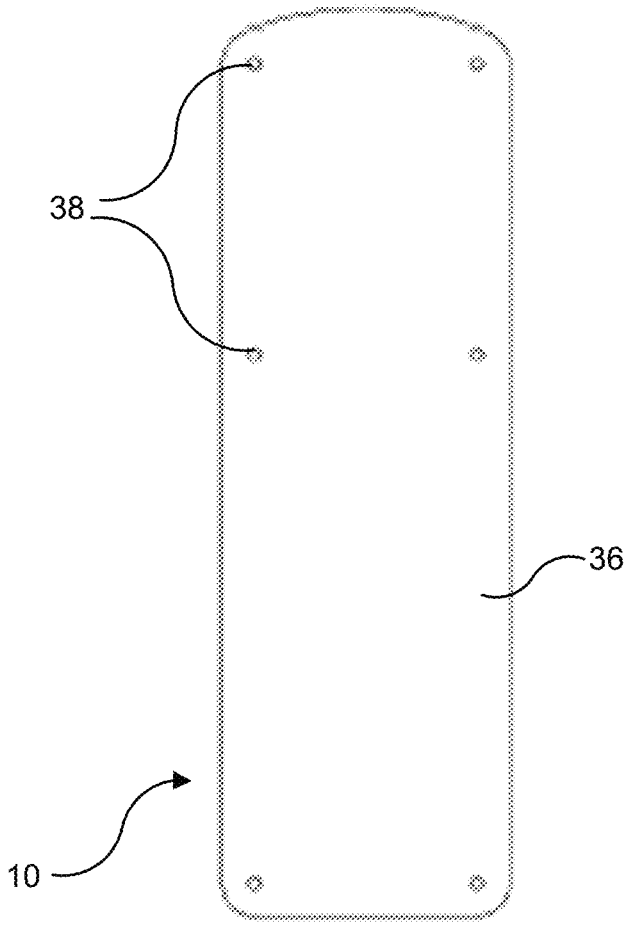
FIG. 3 illustrates the inner side (i.e., the side facing into a confinement room) of the door lock assembly of FIG. 1.

As shown in FIG. 3, the inner side of the door lock assembly according to the present invention may take the form of a simple blank plate (36), affixed to the door (20) (shown in FIG. 4) by way of a plurality (six are shown in FIG. 3) of fasteners (38). Fasteners (38) may be of a conventional type (e.g., a Philips head screw), although preferably the fasteners (38) are of a tamper resistant variety, such as security torx screws or the like.

Figure 4:
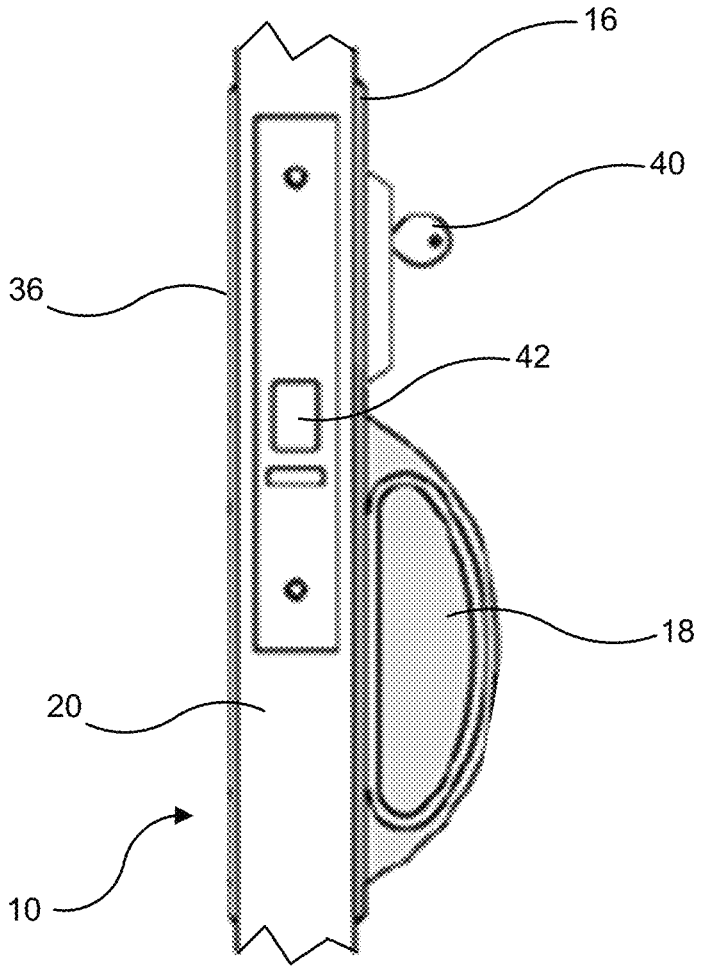
FIG. 4 illustrates a side view of the door lock assembly of FIG. 1 with a key inserted.

FIG. 4 shows a side view of a door lock assembly (10) according to an exemplary embodiment of the present invention incorporating an anti-ligature door pull (18), which is preferred, but not necessary for the invention to function as intended. In this embodiment, actuation of either the primary lock cylinder (12) or the secondary lock cylinder (24) using a key (40) causes a retraction of the lock mechanism (42), and the anti-ligature pull (18) may be used to manipulate the door (20).

The lock mechanism (42) may be biased, such that actuation of one of the lock cylinders causes a temporary retraction of the lock mechanism (42), with an automatic return to the extended position when actuation is ceased (as in the case with a typical door latch). Or the lock mechanism (42) may be not biased, such that one of the lock cylinders must be actuated both to retract and extend the lock mechanism (42), as in the case with a typical deadbolt. However, the present invention may also be used with other types of door hardware arrangements.

Figure 5:
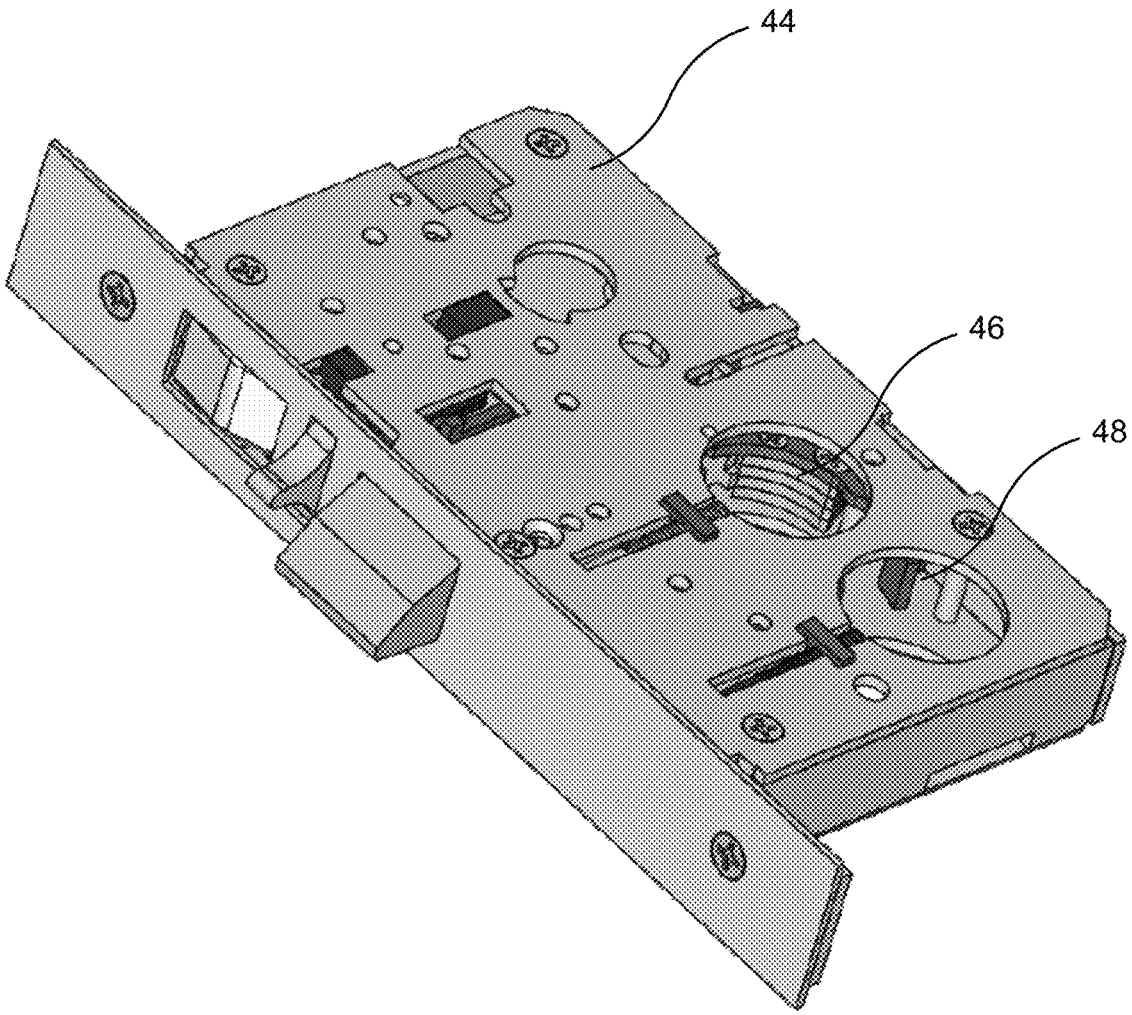
FIG. 5 illustrates portions of the door lock assembly of FIG. 1, in which the mechanism is configured as a mortise lock.

FIG. 5 illustrates portions of door lock assembly (10) according to the present invention, in which the mechanism is configured as a mortise lock.

Mortise door locks are known in the art and typically include a locking mechanism that is set within the body of a door in a recess or mortise, as opposed to one attached to the door surface. Mortise door locks typically include the combination of a latch, operated by a door knob or lever, and a separate deadbolt mechanism. Some mortise door locks omit the deadbolt mechanism.

Since mortise locks are well-known, the operation thereof is not described in detail therein. However, FIG. 5 generally illustrates a mortise lock having a body (44) provided with two openings (46, 28) to accommodate both primary lock cylinder (12) and secondary lock cylinder (24), whereas a typical mortise lock body would generally include only one such opening.

While the lock assembly is shown in the figures as a mortise style lock, one skilled in the art will understand that the features described herein may be applied to other styles and types of door locks.

Although the invention has been described with reference to a particular arrangement of parts, features and the like, these are not intended to exhaust all possible arrangements or features, and indeed many modifications and variations will be ascertainable to those of skill in the art.

What is claimed is:

1. A lock assembly for a door, said lock assembly comprising:

a lock mechanism moveable between an extended position wherein the door is locked and a retracted position wherein the door is unlocked such that the door may be opened and closed;

a first lock cylinder operably connected to said lock mechanism such that actuation of said first lock cylinder causes said lock mechanism to move to the retracted position, said first lock cylinder comprising a first keyhole;

a second lock cylinder operably connected to said lock mechanism such that actuation of said second lock cylinder causes said lock mechanism to move to the retracted position, said second lock cylinder comprising a second keyhole;

wherein said first lock cylinder and said second lock cylinder are both disposed on one and the same side of the door, such that both said first keyhole and said second keyhole are accessible from the one and the same side of the door when the door is closed;

a tamper resistant member moveable between a protected position in which the second keyhole of said second cylinder is inaccessible and an unprotected position in which the second keyhole of said second cylinder is accessible; and wherein a tool is required in order to move said tamper resistant member from the protected position to the unprotected position, said tool adapted to be stored separately from the door.

2. The lock assembly of claim 1 wherein said first lock cylinder and said second lock cylinder are identically keyed, such that one and the same key actuates both said first lock cylinder and said second lock cylinder.

3. The lock assembly of claim 1 wherein said tamper-resistant member comprises a plate moveable between the protected position, in which the plate covers the second keyhole of said second cylinder, and the unprotected position wherein the plate no longer covers the second keyhole of said second cylinder.

4. The lock assembly of claim 3 wherein the plate is pivotably connected to the door on one side, and has an opening on another side adapted to receive a tamper resistant fastener such that plate is fastenable in the protected position using the tamper resistant fastener, but is pivotable to the unprotected position when the tamper resistant fastener is removed.

5. The lock assembly of claim 4 wherein the tamper resistant fastener comprises a security torx screw and said tool comprises a security torx screwdriver.

6. The lock assembly of claim 1 wherein said lock mechanism is biased toward an extended position such that actuation of one of said first lock cylinder and said second lock cylinder causes a temporary retraction of the lock mechanism, with said lock mechanism automatically returning to the extended position when the actuation of one of said first lock cylinder and said second lock cylinder is ceased.

7. The lock assembly of claim 1 wherein said lock mechanism is unbiased such that one of said first lock cylinder and said second lock cylinder must be actuated both to retract and extend said lock mechanism.

8. The lock assembly of claim 1 further comprising a door pull to facilitate opening and closing of the door.

9. The lock assembly of claim 8 wherein said door pull is rounded such that said door pull is free of ligature points.

10. The lock assembly of claim 1 further comprising a first escutcheon plate disposed on a same side of the door as said first lock cylinder, said second lock cylinder and said tamper resistant member.

11. The lock assembly of claim 10 further comprising a second escutcheon plate disposed on an opposite side of the door as said first lock cylinder, said second lock cylinder, said tamper resistant member and said first escutcheon plate.

12. The lock assembly of claim 11 wherein the door is particularly adapted as a door for a confinement room, and wherein the side of the door with the second escutcheon plate faces into the confinement room.

13. The lock assembly of claim 1 wherein said lock assembly is configured as a mortise lock.

14. A lock assembly for a door, said lock assembly comprising:

a lock mechanism moveable between an extended position wherein the door is locked and a retracted position wherein the door is unlocked such that the door may be opened and closed;

a first lock cylinder operably connected to said lock mechanism such that actuation of said first lock cylinder causes said lock mechanism to move to the retracted position, said first lock cylinder comprising a first keyhole;

a second lock cylinder operably connected to said lock mechanism such that actuation of said second lock cylinder causes said lock mechanism to move to the retracted position, said second lock cylinder comprising a second keyhole;

wherein said first lock cylinder and said second lock cylinder are both disposed on one and the same side of the door, such that both said first keyhole and said second keyhole are accessible from the one and the same side of the door when the door is closed;

wherein said first lock cylinder and said second lock cylinder are identically keyed, such that one and the same key actuates both said first lock cylinder and said second lock cylinder; and a plate moveable between a protected position in which said plate covers the second keyhole of said second cylinder such that the second keyhole of said second cylinder is inaccessible and an unprotected position in which the plate no longer covers the second keyhole of said second cylinder such that the second keyhole of said second cylinder is accessible, said plate being pivotably connected to the door on one side, and having an opening on another side adapted to receive a tamper resistant fastener such that plate is fastenable in the protected position using the tamper resistant fastener, but is pivotable to the unprotected position when the tamper resistant fastener is removed.

15. The lock assembly of claim 14 wherein a tool is required in order to remove the tamper resistant fastener such that said plate is moveable from the protected position to the unprotected position, said tool adapted to be stored separately from the door.

16. The lock assembly of claim 15 wherein the tamper resistant fastener comprises a security torx screw and said tool comprises a security torx screwdriver.

17. The lock assembly of claim 14 wherein said lock mechanism is biased toward an extended position such that actuation of one of said first lock cylinder and said second lock cylinder causes a temporary retraction of the lock mechanism, with said lock mechanism automatically returning to the extended position when the actuation of one of said first lock cylinder and said second lock cylinder is ceased.

18. The lock assembly of claim 14 wherein said lock mechanism is unbiased such that one of said first lock cylinder and said second lock cylinder must be actuated both to retract and extend said lock mechanism.

19. The lock assembly of claim 14 further comprising a door pull to facilitate opening and closing of the door.

20. The lock assembly of claim 19 wherein said door pull is rounded such that said door pull is free of ligature points.

21. The lock assembly of claim 14 further comprising a first escutcheon plate disposed on a same side of the door as said first lock cylinder, said second lock cylinder and said plate.

22. The lock assembly of claim 21 further comprising a second escutcheon plate disposed on an opposite side of the door as said first lock cylinder, said second lock cylinder, said plate and said first escutcheon plate.

23. The lock assembly of claim 22 wherein the door is particularly adapted as a door for a confinement room, and wherein the side of the door with the second escutcheon plate faces into the confinement room.

24. The lock assembly of claim 14 wherein said lock assembly is configured as a mortise lock.

* * * * *